US005220336A

United States Patent [19]

Hirotsu et al.

[11] Patent Number: 5,220,336

[45] Date of Patent: Jun. 15, 1993

[54] VEHICLE WINDOW GLASS ANTENNA FOR TRANSMISSION AND RECEPTION OF ULTRASHORT WAVES

[75] Inventors: Tohru Hirotsu; Tokio Tsukada; Yoji Nagayama; Kazuhiko Fujii; Masao Shinnai; Kazuya Nishikawa, all of Matsusaka, Japan

[73] Assignee: Central Glass Company, Limited, Ube, Japan

[21] Appl. No.: 660,012

[22] Filed: Feb. 25, 1991

[30] Foreign Application Priority Data

Feb. 28, 1990 [JP] Japan ..... 2-48056
Feb. 28, 1990 [JP] Japan ..... 2-48057
Mar. 30, 1990 [JP] Japan ..... 2-83473

[51] Int. Cl.[5] ..... H01Q 1/32
[52] U.S. Cl. ..... 343/713
[58] Field of Search ..... 343/713, 704; 219/203; 347/711, 712

[56] References Cited

U.S. PATENT DOCUMENTS 4,439,774 3/1984 Kume et al. ..... 343/713
4,608,570 8/1986 Inaba et al. ..... 343/713
4,803,492 2/1989 Inaba et al. ..... 343/713

FOREIGN PATENT DOCUMENTS 2060418 6/1971 Fed. Rep. of Germany ..... 343/713
0024802 8/1979 Japan ..... 343/713
0196605 4/1983 Japan ..... 343/713
0210705 9/1986 Japan .
62-26912 2/1987 Japan .
0031203 2/1987 Japan ..... 343/713
62-69704 3/1987 Japan .
0224406 9/1990 Japan .
2235094 2/1991 United Kingdom .

*Primary Examiner*—Rolf Hille
*Assistant Examiner*—Tan Ho
*Attorney, Agent, or Firm*—Keck, Mahin & Cate

[57] ABSTRACT

The invention provides a vehicle window glass antenna for transmission and reception of ultrashort waves used for mobile phones and/or personal radios. The antenna has a primary antenna which is a combination of at least two vertical (in the sense of perpendicular to a horizontal line) elements and at least two horizontal elements each of which directly connects with at least one of the vertical elements and a secondary antenna which is essentially a horizontally elongate element located in a space between the primary antenna and the lower or upper edge of the window glass. The primary antenna is arranged within a rectangular area having a limited horizontal width and a limited length, and the horizontal element of the secondary antenna has a limited length. The antenna feeder is a coaxial cable, and the primary antenna and the secondary antenna are connected with the inner conductor and the outer conductor of the coaxial cable, respectively. In a preferred embodiment the major part of the primary antenna is in the form of a rectangular grid.

31 Claims, 9 Drawing Sheets

VEHICLE WINDOW GLASS ANTENNA FOR TRANSMISSION AND RECEPTION OF ULTRASHORT WAVES

BACKGROUND OF THE INVENTION

This invention relates to an antenna provided to a vehicle window glass for transmitting and receiving ultrashort waves, the antenna being made up of a plurality of conductive strips attached to the window glass in a suitable pattern. The antenna is particularly suitable to mobile phones and/or personal radio transmitter-receivers installed on automobiles.

In the current automobiles it is customary to use a pole antenna for the transmission and reception of ultrashort waves assigned to mobile phones and/or personal radios. However, the protrusion of a pole antenna from a car body is unfavorable for safety and also for good appearance of the car. Besides, pole antennas are obstructive to car washing and sometimes break.

There are some proposals of providing an antenna for transmission and reception of ultrashort waves on an automobile window glass: for example, JP-A 62-69704 and JP-A (Utility Model) 62-26912. However, window glass antennas proposed until now are considerably low in transmission and reception gains compared with conventional pole antennas and hence cannot be put into practical use for car telephones or personal radios.

SUMMARY OF THE INVENTION

It is an object of the present invention to provide a vehicle window glass antenna, which is suited to automobiles and capable of transmitting and receiving ultrashort waves assigned to mobile phones and personal radios with sufficiently high gains.

The present invention provides an antenna attached to a vehicle window glass for transmitting and receiving ultrashort waves, and particularly waves assigned to mobile phones and/or personal radios, the antenna comprising a primary antenna which is a combination of at least two parallel vertical elements each of which is a conductive linear element extending perpendicular to a horizontal line and at least two horizontal elements each of which is a conductive linear element extending horizontally and directly connects with at least one of the vertical elements, the primary antenna being arranged within a rectangular area ranging from 10 to 120 mm in horizontal width and from 20 to 120 mm in length perpendicular to the horizontal width, a secondary antenna comprising a horizontally elongate conductive element which extends in a space between the aforementioned rectangular area and one of upper and lower edges of the window glass and has a length in the range from 30 to 300 mm, and a feeder which is a coaxial cable having an inner conductor and an outer conductor with insulation therebetween. The primary antenna is connected with the inner conductor of the coaxial cable whereas the secondary antenna is connected with the outer conductor.

In this specification, the term "vertical element" is used in the sense of a linear element which extends perpendicular to a horizontal line.

Mobile phones and personal radios on automobiles transmit and receive vertically polarized waves. Therefore, a vertical element serves as an important element of an automobile window glass antenna for the operation of car telephones and/or personal radios, and it is favorable that the length of the vertical element is close to a resonance length, $\lambda \cdot \alpha/4$, where $\lambda$ is the wavelength of the wave to be transmitted and received, and $\alpha$ is a wavelength shortening coefficient of the window glass (usually $\alpha$ is about 0.6), and hence ranges from about 20 mm to about 80 mm. However, in the case of a window glass antenna it is impossible to realize sufficiently high transmission and reception gains over a fairly wide range of frequency with such a vertical element alone.

In the present invention at least two vertical elements in parallel arrangement are combined with at least two horizontal elements so as to constitute a primary antenna which is specifically limited in both horizontal width and length perpendicular to the width, and the primary antenna is combined with a secondary antenna which is essentially a horizontally elongate element spaced from the elements of the primary antenna. A feeder for a window glass antenna according to the invention is a standard coaxial cable. In this invention the primary antenna is connected with the inner conductor of the coaxila cable and the secondary antenna with the outer conductor, whereby the window glass antenna becomes an ungrounded antenna. This manner of connection contributes to impedance matching between the antenna and the coaxial cable, which is an unbalanced feeder system, and consequently produces the effect of reducing loss of the antenna and enhancing the transmission and reception gains of the antenna.

A window glass antenna according to the invention can be constructed in a relatively small area in a vehicle window glass, and this antenna is sufficiently high in transmission and reception gains for ultrashort waves used for mobile phones and personal radios. Besides, this antenna can be used for reception of television broadcast waves in the UHF band. This antenna is particulary suitable and practicable as an automobile window glass antenna.

In a preferred embodiment of the invention, the vertical and horizontal elements of the primary antenna form a rectangular grid as the major part of the primary antenna, and in the grid the spacings between the vertical elements and the spacings between the horizontal elements are not greater than 20 mm. In this case it is suitable to arrange the primary antenna within a rectangular area ranging from 10 to 120 mm in horizontal width and from 20 to 60 mm in length perpendicular to the width.

In another preferred embodiment, each of the horizontal elements of the primary antenna extends from an end of one of the vertical elements, and the primary antenna includes an impedance matching element which is a linear element bent so as to have at least one horizontal part crossing the vertical elements and at least one vertical part extending parallel to the vertical elements. In this case it is suitable to arrange the primary antenna within a rectangular area ranging from 10 to 120 mm in horizontal width and from 30 to 100 mm in length perpendicular to the width.

In another preferred embodiment, the primary antenna has, besides at least two parallel vertical elements, a linear element which is bent at right angles so as to constitute the perimeter of a closed plane figure in the shape of a rectangular having a rectangular cut in one side thereof. The rectangle is arranged such that said one side becomes a horizontal side and such that each of the vertical elements directly connects with at least one horizontal side of the rectangle. In this case it is suitable to arrange the primary antenna within a rectangular area ranging from 20 to 75 mm in horizontal width and from 20 to 120 mm in length perpendicular to the width.

DESCRIPTION OF THE PREFERRED EMBODIMENTS

Figure 1:
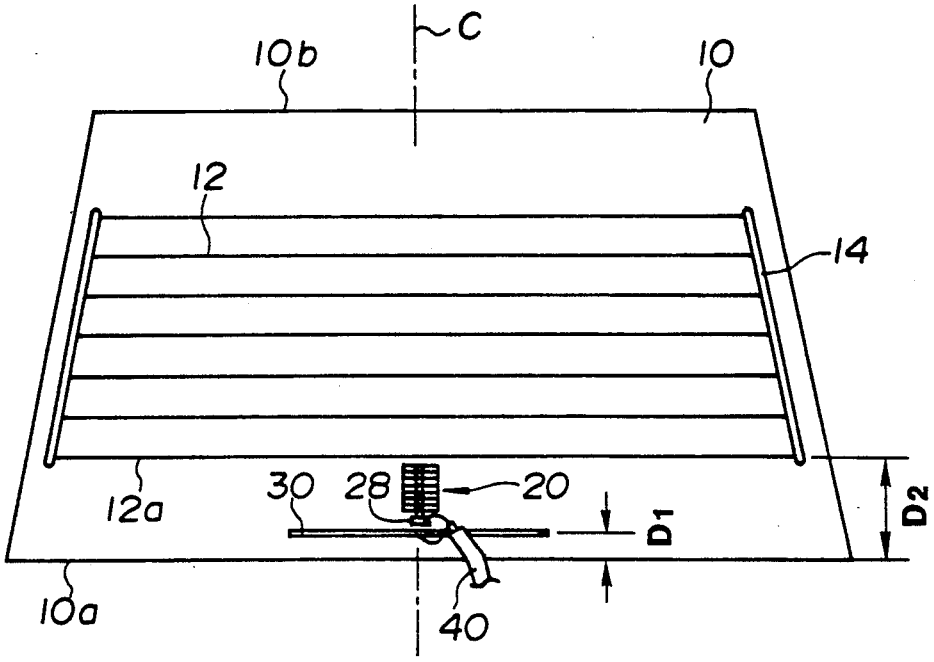
FIG. 1 is a plan view of an automobile rear window glass provided with an antenna according to the invention in a space below defogging heater strips.

FIG. 1 shows an automobile rear window glass in which the present invention is embodied in a preferred manner. A single piece of glass plate 10 is used as the window glass. An array of defogging heater strips 12 is disposed on the inboard surface of the window glass 10 so as to leave an open space between the lower edge 10*a* of the glass 10 and the lowermost heater strip 12*a*. The heater strips 12 extend horizontally and connect with a pair of bus bars 14.

Using the open space below the heater strips 12 an antenna according to the invention is disposed on the inboard surface of the window glass 10. Essentially the antenna is a combination of a primary antenna 20 and a secondary antenna 30. The primary antenna 20 is made up of a plurality of wire-like conductive strips and is connected to a feed point 28. The secondary antenna 30 is a single conductive strip having some width, and it is spaced from the primary antenna 30.

Usually the elements of the primary and secondary antennas 20, 30 and the feed point 28 as well as the heater strips 12 and the bus bars 14 are formed by printing a conductive paste onto the glass surface and, after drying, baking the glass plate with the printed paste thereon.

A coaxial cable 40 is used to connect the antenna to a transmitter-receiver (not shown) installed in the automobile. The coaxial cable 40 has an inner conductor (core) 42 and a tubular outer conductor 44 with an insulator (not shown) between the two conductors 42, 44. According to the invention the inner conductor 42 is connected to the feed point 28 to which the primary antenna 20 is connected, and the outer conductor 44 is connected to the secondary antenna 30. The outer conductor 44 is grounded at the chassis of the transmitter-receiver.

Figure 2:
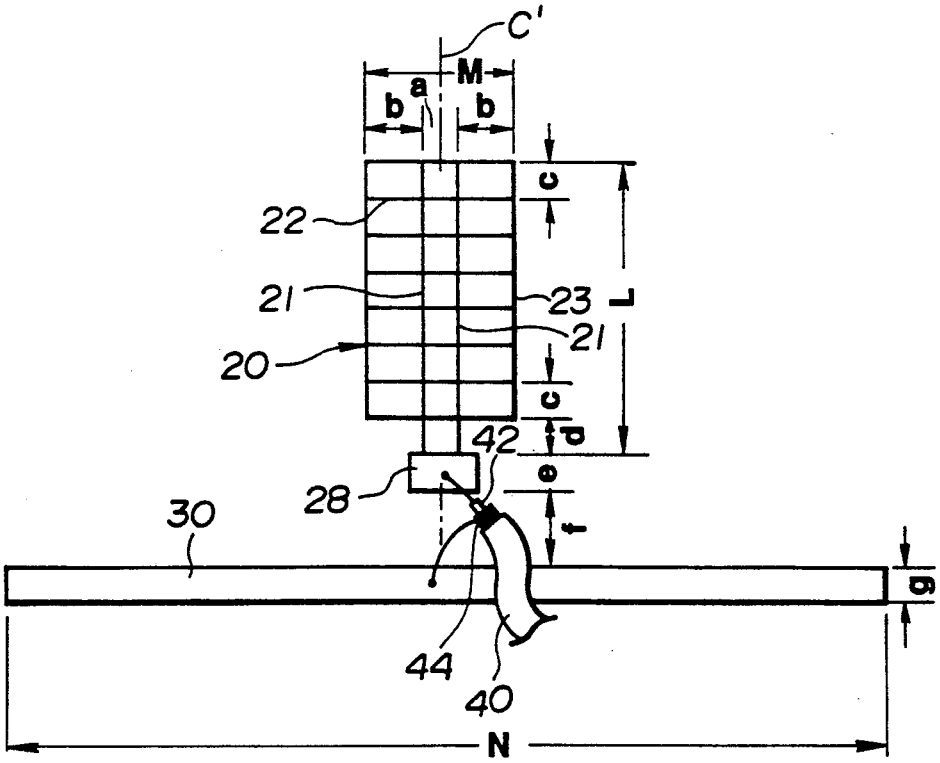
FIG. 2 is an enlarged view of the antenna in FIG. 1.

As shown in FIG. 2 the primary antenna 20 is of a rectangular grid pattern. The antenna 20 consists of two parallel vertical elements 21 having the same length, several parallel horizontal elements 22 which have the same length and intersect the vertical elements 21 at approximately the same intervals and two supplementary vertical elements 23 which connect the horizontal elements 22 to each other at their right-hand ends and left-hand ends, respectively. The two central vertical elements 21 connect at their lower ends to the feed point 28.

In this embodiment the longitudinal center axis C′ of the primary antenna 20 is approximately on the longitudinal center axis C of the window glass 10. The horizontal secondary antenna 30 is positioned below the feed point 28 so as to be approximately bisected by the center axis C′. It is suitable that the distance of the primary antenna 20 from the lowermost heater strip 12*a* is not shorter than 15 mm. As to the position of the secondary antenna 30 it is suitable that this antenna 30 is at least 20 mm distant from the lower edge 10*a* of the window glass or from the car body and at a distance of 5–30 mm, and preferably 10–25 mm, from the feed point 28.

In a sample of the window glass shown in FIGS. 1 and 2, the glass plate 10 was 1600 mm in the length of the lower edge 10*a*, 1180 mm in the length of the upper edge 10*b* and 735 mm in the length perpendicular to the upper and lower edges, and the distance $D_2$ of the array of heater strips 12 from the lower edge 10*a* was 120 mm. The dimensions of and relating to the antenna elements were as follows.

In the primary antenna 20 the length M of the horizontal elements 22 was 20 mm, and the length L of the two central vertical elements 21 was 40 mm. As to the grid pattern: a was 5 mm, b was 7.5 mm and c was 5 mm. Length d was 5 mm. The feed point 28 had a vertical width, e, of 5 mm and at a distance, f, of 15 mm from the secondary antenna 30. As to the secondary antenna 30 the length N was 140 mm, and the width g was 5 mm, and the distance $D_1$ from the lower edge 10*a* of the glass 10 was 35 mm.

With this sample, gains of the antenna in transmitting and receiving radio waves in the 860–940 MHz band for car telephones with vertical polarization were measured and compared with gains of a standard half-wave dipole antenna. That is, for any frequency the gain of the dipole antenna was taken as the basis, 0 dB, and the gain of the sample antenna was marked on this basis. The results are shown in Table 1.

TABLE 1

| Frequency (MHz) | Gain (dB) |
|---|---|
| 860 | −3.0 |
| 865 | −2.7 |
| 870 | −1.6 |
| 875 | −1.1 |
| 880 | +2.5 |
| 885 | +0.2 |
| 915 | +0.3 |
| 920 | −0.7 |
| 925 | −2.8 |
| 930 | −4.2 |
| 935 | −4.4 |
| 940 | −4.6 |
| average | −1.4 |

Considering that pole antennas currently used in automobiles are nearly equivalent to a half-wave dipole antenna in transmission and reception gains, the window glass antenna shown in FIGS. 1 and 2 can be judged to be sufficiently efficient and comparable to the conventional pole antennas.

When the same sample antenna was used for the transmission and reception of vertically polarized waves for personal radios with 904 MHz as the central frequency, an average gain (vs. half-wave dipole antenna) was +0.5 dB. Since conventional pole antennas for automobiles are nearly equivalent to the half-wave dipole antenna, the tested window glass antenna is regarded as comparable to or slightly better than the conventional pole antennas.

When the same sample antenna was used for the reception of TV broadcast waves in the UHF band of 470–770 MHz, an average gain (vs. standard dipole antenna) was −15.1 dB with respect to horizontal polarization and −13.5 dB with respect to vertical polarization. That is, with this window glass antenna it is possible to receive UHF TV broadcasting.

Figure 3:
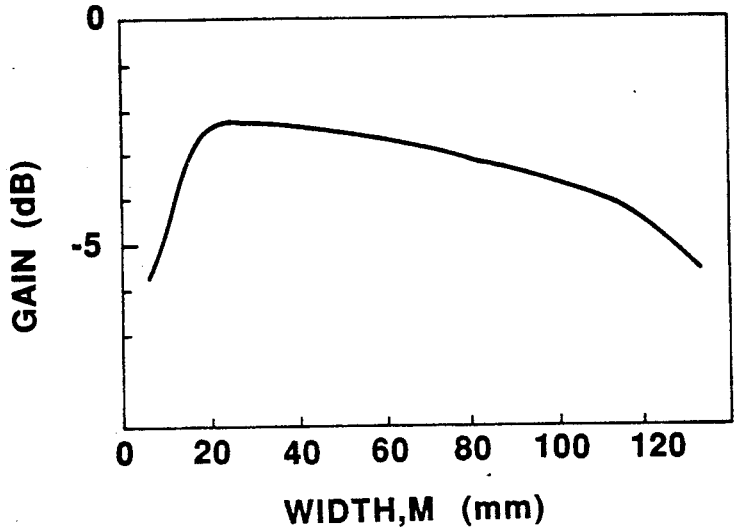
FIG. 3 is a graph showing the relationship between the lateral width of a primary antenna in the antenna of FIG. 2 and an average gain of the antenna in transmitting and receiving ultrashort waves for car telephone.

In an antenna according to the invention the lateral length M of the primary antenna 20 is not shorter than 10 mm and not longer than 120 mm. This limitation is important for realization of high transmission and reception gains. In this regard, FIG. 3 shows the result of an experiment on the above described sample of the window glass antenna of FIGS. 1 and 2. In the experiment the lateral length M of the primary antenna 20 was varied at intervals of 10 mm, while the spacings a, b between the vertical elements and the spacings c between the horizontal elements were all kept constant at 5 mm so that these spacings were shorter than 1/16 of the wavelength (λ) of the radio wave for car telephones or personal radios to be transmitted and received. That is, according to the need the number of supplementary vertical elements represented by the two elements 23 in FIG. 2 was varied. The vertical length L of the primary antenna 20 was constantly 40 mm, which is close to the resonance length, $\lambda \cdot \alpha/4$, of the radio wave to be transmitted and received. In the experiment each sample antenna was used for transmitting and receiving radio waves in the 860–940 MHz band, and an average gain (vs. half-wave dipole antenna) in this band was plotted in FIG. 3. The appropriateness of limiting the width M of the primary antenna 20 in the range from 10 to 120 mm can be seen in FIG. 3. It is preferable that the width M is within the range from 15 to 80 mm.

Figure 4:
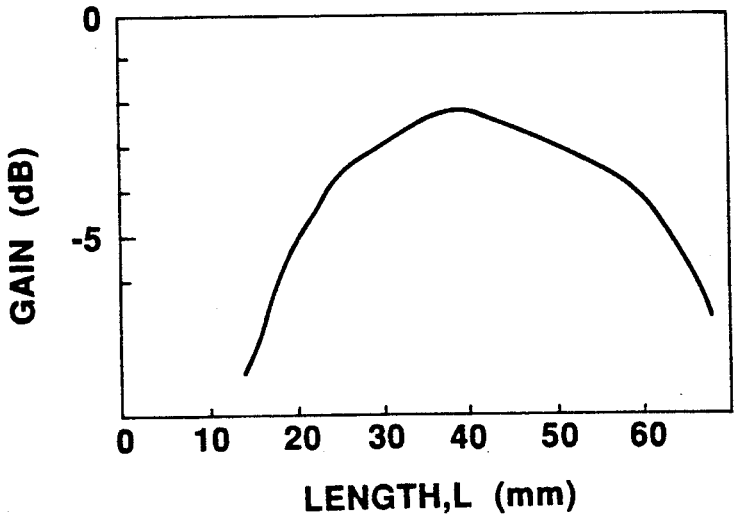
FIG. 4 is a graph showing the relationship between the longitudinal length of the same primary antenna and the average gain of the antenna.

In another experiment on the sample of the window glass antenna of FIGS. 1 and 2 the vertical length L of the primary antenna 20 was varied at intervals of 10 mm, while the spacings c between the horizontal elements were kept constant at 5 mm. That is, the number of the horizontal elements 22 were varied. The width M of the primary antenna 20 was constantly 20 mm. For the transmission and reception of waves in the 860–940 MHz, an average gain (vs. half-wave dipole antenna) was as plotted in FIG. 4. As can be seen in FIG. 4 it is suitable to limit the length L of the primary antenna 20 within the range from 20 to 60 mm. It is preferable that the length L is within the range from 30 to 50 mm.

As to the grid-like pattern of the primary antenna 20 it is preferable that each of the spacings a, b and c is in the range from 4 to 20 mm. That is, it is intended to make these spacings a, b, c shorter than 1/16 of the wavelength (λ) of the wave to be transmitted and received, because by doing so the rectangular grid of the antenna 20 becomes nearly equivalent to a metal sheet having the same area (M×(L−d) in FIG. 2).

Figure 5:
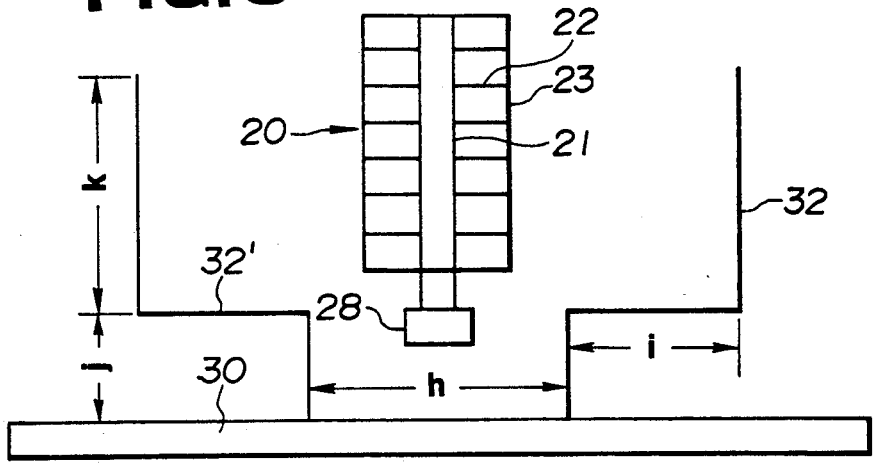
FIGS. 5 to 7 show three different modifications of the antenna of FIG. 2, respectively.

FIG. 5 shows a modification of the window glass antenna in FIG. 2 in two points. First, in the grid-like primary antenna 20 most of the horizontal elements 22 are cut into shorter pieces so as not to extend through the space between the two central vertical elements 21. Second, the window glass antenna includes a pair of auxiliary antenna elements 32 and 32' which are arranged symmetrically with respect to the primary antenna 20 and are respectively connected to the secondary antenna 30. Each of the auxiliary antenna element 32, 32' is a linear element which is bent so as to have a horizontal portion and two vertical portions. In a sample of the antenna of FIG. 5: the distance h was 30 mm, lengths i and j were each 5 mm, and length k was 15 mm.

Figure 6:
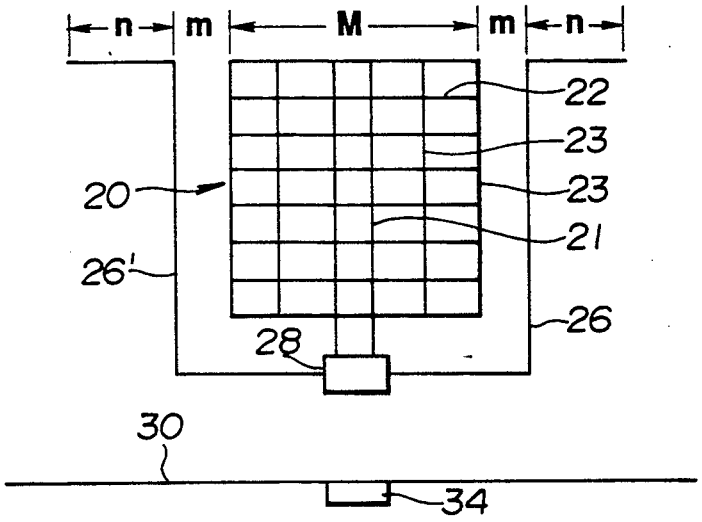

FIG. 6 shows another modification of the antenna of FIG. 2. First, the primary antenna 20 is laterally enlarged with an increase in the number of the supplementary vertical elements 23. Second, the window glass antenna includes a pair of auxiliary antenna elements 26 and 26' which are arranged symmetrically with respect to the primary antenna 20 and are respectively connected to the feed point 28. Each of the auxiliary elements 26, 26' is a linear element which is bent so as to have a vertical portion and two horizontal portions. Besides, the horizontal secondary antenna 30 is in the form of a wire-like thin strip, and the thin secondary antenna 30 is connected to a second feed point 34 for connection with the outer conductor 44 of the coaxial cable 40. In a sample of the antenna of FIG. 6: the width M of the primary antenna 20 was 20 mm, distance m was 10 mm, length n was 20 mm, and the length of the secondary antenna 30 was 120 mm.

Figure 7:
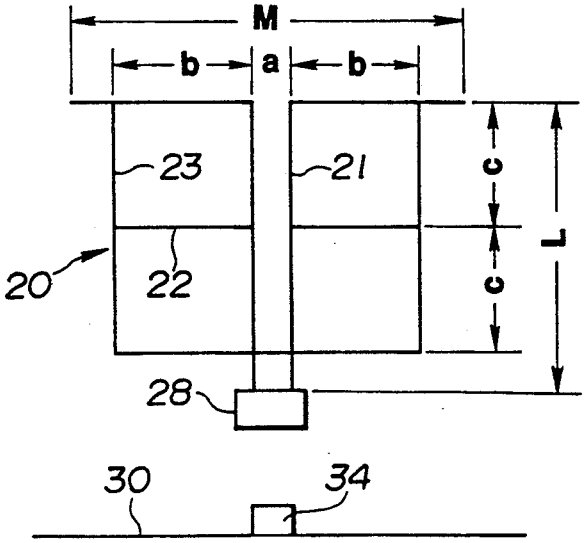

FIG. 7 shows a further modification of the antenna of FIG. 2. In the primary antenna 20 both the spacings b between vertical elements and the spacings c between horizontal elements are enlarged by increasing the width M of the antenna 20 and decreasing the number of horizontal elements 22. The secondary antenna 30 is in the form of a wire-like thin strip, and the thin secondary antenna 30 is directly connected to a feed point 34 which is for the same purpose as the feed point 34 in FIG. 6. In a sample of the antenna of FIG. 7: a was 5 mm, b was 15 mm, c was 20 mm, M was 45 mm, and L was 45 mm.

In the aforementioned samples of the antennas of FIGS. 5, 6 and 7, the dimensions of the glass plate and the antenna elements were the same as in the sample of the antenna shown in FIGS. 1 and 2 except the particularly mentioned dimensions of the modified or added elements. With respect to the samples of the antennas of FIGS. 5, 6 and 7, Table 2 shows average gains (vs. half-wave dipole antenna) in transmitting and receiving waves in the 880–940 MHz band for car telephones and average gains (vs. half-wave dipole antenna) in transmitting and receiving vertically polarized waves for personal radios with 904 MHz as the central frequency. These test results indicate that the antennas of FIGS. 5, 6 and 7 are all nearly equivalent to the antenna of FIG. 2.

TABLE 2

| | Average Gain (dB) | |
|---|---|---|
| | 860–940 MHz | around 904 MHz |
| antenna of FIG. 5 | −1.9 | −0.5 |

TABLE 2-continued

| | Average Gain (dB) | |
|---|---|---|
| | 860-940 MHz | around 904 MHz |
| antenna of FIG. 6 | −1.8 | +0.1 |
| antenna of FIG. 7 | −2.1 | −0.9 |
| antenna of FIG. 2 | −1.4 | +0.5 |

An antenna according to the invention does not necessarily have antenna elements other than the primary and secondary antennas 20 and 30. However, according to the type of the car to which the invention is applied it is optional to add an auxiliary antenna element or auxiliary antenna elements, such as the elements 32, 32' in FIG. 5 or the elements 26, 26' in FIG. 6, for the purpose of enhancing the transmission and reception gains and/or improving the directional characteristics.

Figure 8:
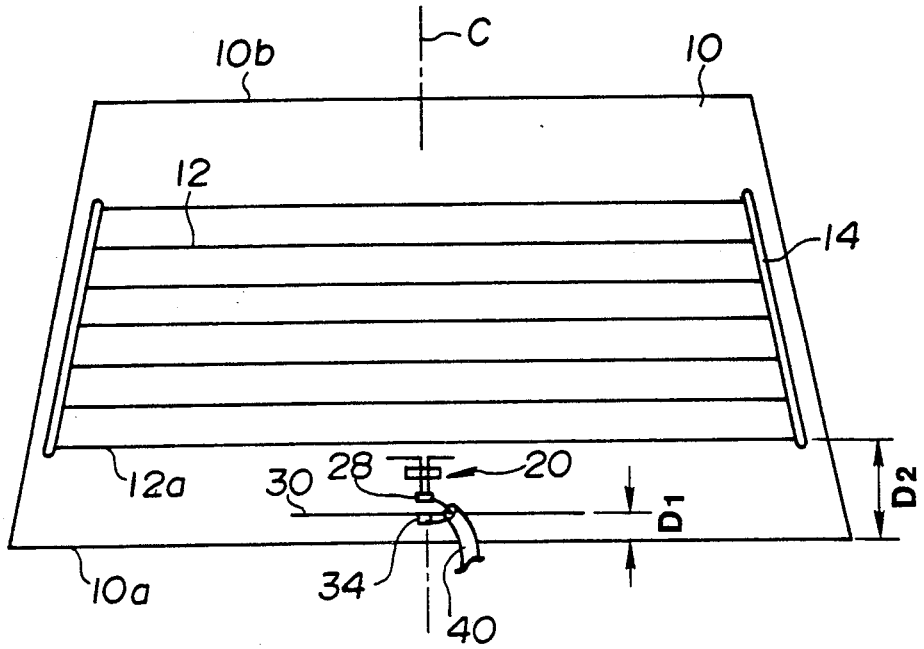
FIG. 8 is a plan view of an automobile rear window glass provided with another antenna according to the invention.
Figure 9:
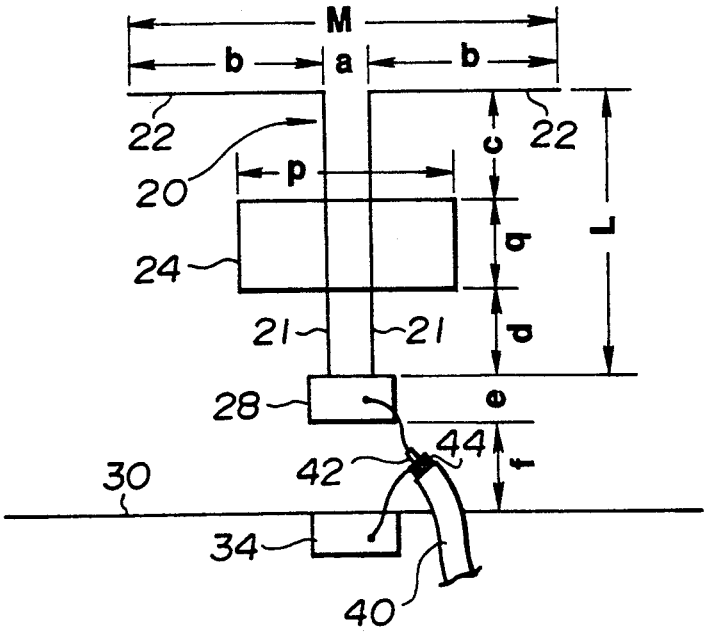
FIG. 9 is an enlarged view of the antenna in FIG. 8.

FIGS. 8 and 9 show another preferred construction of the primary antenna 20 in an antenna according to the invention. On the inboard surface of the automobile rear window glass 10 the position of the primary antenna 20 is as described with respect to the embodiment shown in FIGS. 1 and 2. The primary antenna 20 has two parallel vertical elements 21 having the same length, and a horizontal element 22 extends from the upper end of each vertical element 21 toward a side edge of the window glass 10. The antenna 20 has another wire-like element 24 which is bent so as to form four sides of a rectangle arranged such that two parallel sides of the rectangle perpendicularly intersect the two vertical elements 21. The two vertical elements 21 connect at their lower ends to the feed point 28 for connection with the inner conductor 42 of the coaxial cable 40. In this antenna the horizontal secondary antenna 30 and the feed point 34 for connection of the antenna 30 with the outer conductor 44 of the coaxial cable 40 are similar to the counterparts in FIG. 6.

In a sample of the window glass shown in FIGS. 8 and 9 the dimensions of the glass plate 10 were the same as in the sample of the window glass of FIG. 1. The distance $D_2$ of the array of heater strips 12 from the lower edge 10*a* of the glass was 120 mm.

As to the primary antenna 20: the horizontal width M was 58 mm, vertical length L was 55 mm, and the rectangle of the element 24 was 36 mm in horizontal width p and 15 mm in length q. More in detail: a was 6 mm, b was 26 mm, c was 25 mm, and d was 15 mm. As to the feed point 28: width e was 5 mm and distance f from the secondary antenna 30 was 10 mm. The length of the secondary antenna 30 was 130 mm.

With this sample antenna transmission and reception gains (vs. half-wave dipole antenna) for vertically polarized waves in the 860–940 MHz band for car telephones were as shown in Table 3.

TABLE 3

| Frequency (MHz) | Gain (dB) |
|---|---|
| 860 | −4.2 |
| 865 | −8.5 |
| 870 | −2.5 |
| 875 | −2.1 |
| 880 | +1.9 |
| 885 | −0.8 |
| 915 | −1.1 |
| 920 | −1.4 |
| 925 | −2.3 |

TABLE 3-continued

| Frequency (MHz) | Gain (dB) |
|---|---|
| 930 | −3.6 |
| 935 | −4.0 |
| 940 | −4.7 |
| average | −2.3 |

When this sample antenna was used for the transmission and reception of vertically polarized waves for personal radios with 904 MHz as the central frequency, an average gain (vs. half-wave dipole antenna) was −0.5 dB.

These test results indicates that the antenna of FIG. 9 is comparable to conventional pole antennas. When the same sample antenna was used for the reception of TV broadcast waves in the UHF band of 470–770 MHz, an average gain (vs. standard dipole antenna) was −15.3 dB with respect to horizontal polarization and −13.6 dB with respect to vertical polarization. That is, with this window glass antenna it is possible to receive UHF TV broadcasting.

In the antenna of FIG. 9 the rectangularly arranged element 24 is included mainly for the sake of impedance matching. In the above described sample antenna, the resistance R and the reactance X between the primary antenna 20 and the feed point 28 were measured at several frequencies. The measurements were as shown in Table 4, wherein a positive (+) value of the reactance means inductive reactance and a negative value (−) capacitive reactance. When the impedance matching element 24 was omitted from the sample the measurements were as shown in the right-hand columns of Table 4.

TABLE 4

| Frequency (MHz) | With Element 24 R (Ω) | With Element 24 X (Ω) | Without Element 24 R (Ω) | Without Element 24 X (Ω) |
|---|---|---|---|---|
| 870 | 102 | −4 | 186 | −18 |
| 876 | 85 | −10 | 146 | −57 |
| 882 | 60 | −2 | 103 | −67 |
| 925 | 68 | −11 | 62 | +84 |
| 931 | 53 | +5 | 110 | +116 |
| 937 | 52 | +25 | 206 | +101 |

Coaxial cables used as feeders for car telephones and personal radios have a standard impedance of 50 Ω. In Table 4 it is seen that in the antenna of FIG. 9 having the impedance matching element 24 the resistance R is relatively close to 50 Ω, and the reactance X is close to 0 Ω. Thus, the impedance of the antenna of FIG. 9 is matched to that of the coaxial cable 40 so that the antenna serves the purpose of efficient transmission and reception. When the impedance matching element 24 was omitted, an average gain (vs. half-wave dipole antenna) of the sample antenna in the 860–940 MHz became −7.5 dB which is far lower than −2.3 dB in Table 3.

Figure 10:
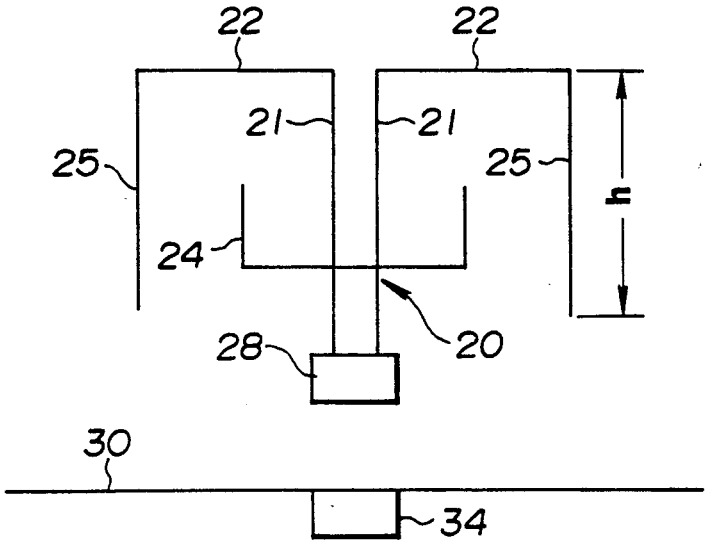
FIGS. 10 to 12 show three different modifications of the antenna of FIG. 9, respectively.

FIG. 10 shows a modification of the antenna of FIG. 9. First, each of the two horizontal elements 22 of the primary antenna 20 is supplemented with a vertical element 25 which extends downward from the free end of the original horizontal element 22. Second, the element 24 of the primary antenna 20 forms only three sides of a rectangle arranged such that only one side of the rectangle intersect the two vertical elements 21. In a sample of this antenna the length h of each supplementary vertical element 25 was 50 mm.

Figure 11:
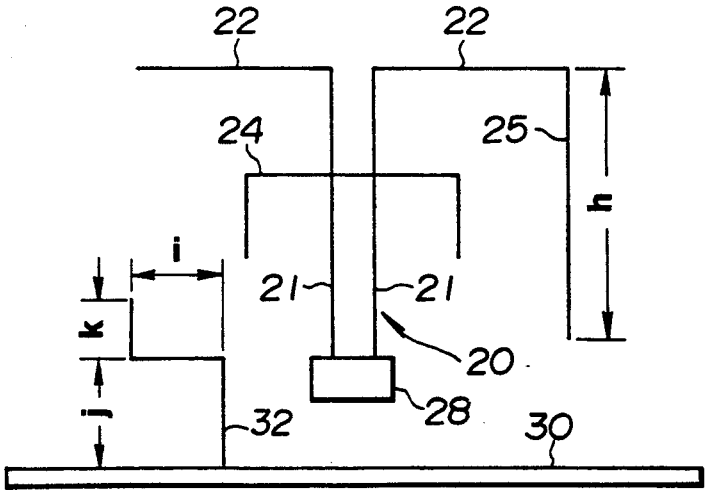

FIG. 11 shows a further modification of the antenna of FIG. 10. In this case only one of the two horizontal elements 22 is supplemented with the vertical element 25, and the impedance matching element 24 is reversely arranged. The secondary antenna 30 has some width so that the second feed point 34 is omitted, and there is provided an auxiliary antenna element 32 which is analogous to the element 32 or 32' in FIG. 5 and connected to the secondary antenna 30. In a sample of this antenna: h was 50 mm, i was 20 mm, j was 25 mm and k was 15 mm.

Figure 12:
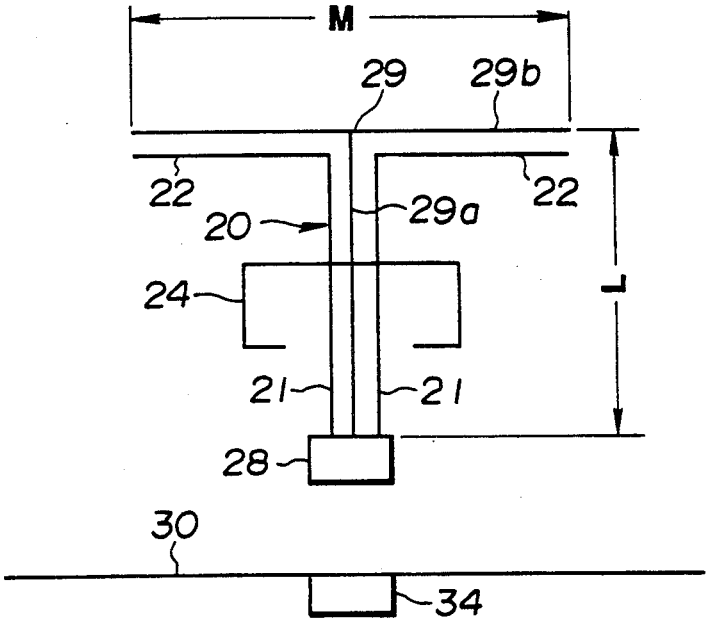

FIG. 12 shows another modification of the antenna of FIG. 9. First, the primary antenna 20 is supplemented with a T-shaped element 29. The vertical part **29*a* of the T-shaped element 29 directly connects with the feed point 28 and extends between the two vertical elements 21, and the horizontal part 29*b* of the element 29 extends slightly above the two horizontal elements 22 without intersecting the vertical elements 21. Second, the element 24 is slightly shortened so as to omit a central part of one horizontal side of the rectangle, whereby only one horizontal side of the rectangle intersects the two vertical elements 21 and the vertical part 29*a* of the T-shaped element 29. In a sample of this antenna, M (length of the horizontal part 29*b* of the T-shaped element) was 38 mm, and L (length of the vertical part 29*a*** of the T-shaped element) was 50 mm.

In the aforementioned samples of the antennas of FIGS. 10, 11 and 12, the dimensions of the glass plate and the antenna elements were the same as in the sample of the antenna shown in FIGS. 8 and 9 except the particularly mentioned dimensions of the modified or added elements. With respect to the samples of the antennas of FIGS. 10, 11 and 12, Table 5 shows average gains (vs. half-wave dipole antenna) in transmitting and receiving waves in the 860–940 MHz band for car telephones and average gains (vs. half-wave dipole antenna) in transmitting and receiving vertically polarized waves for personal radios with 904 MHz as the central frequency. These test results indicate that the antennas of FIGS. 10, 11 and 12 are all nearly equivalent to the antenna of FIG. 9.

TABLE 5

| | Average Gain (dB) | |
|---|---|---|
| | 860–940 MHz | around 904 MHz |
| antenna of FIG. 10 | −2.1 | −0.5 |
| antenna of FIG. 11 | −2.4 | −0.8 |
| antenna of FIG. 12 | −2.6 | −0.7 |
| antenna of FIG. 9 | −2.3 | −0.5 |

In an antenna of the type shown in FIGS. 8–12 the maximum (M) of the horizontal length of the primary antenna 20 is in the range from 10 to 120 mm, and the maximum (L) of the vertical length of the antenna 20 is in the range from 30 to 100 mm. The impedance matching element 24 of the antenna 20 does not necessary form three or four sides of a rectangle. It is also possible to employ an L-shaped or inverted L-shaped element as the element 24 in such an arrangement that a horizontal part of the L-shaped element intersects the two vertical elements 21. The length and position of the secondary antenna 30 are as described with reference to FIGS. 1–7. The auxiliary antenna element 32 in FIG. 11 is added for the purposes explained hereinbefore with reference to FIGS. 5 and 6. Also it is possible to add an auxiliary antenna element or auxiliary antenna elements to the primary antenna 20 in an antenna of the type shown in FIGS. 8–12.

Figure 13:
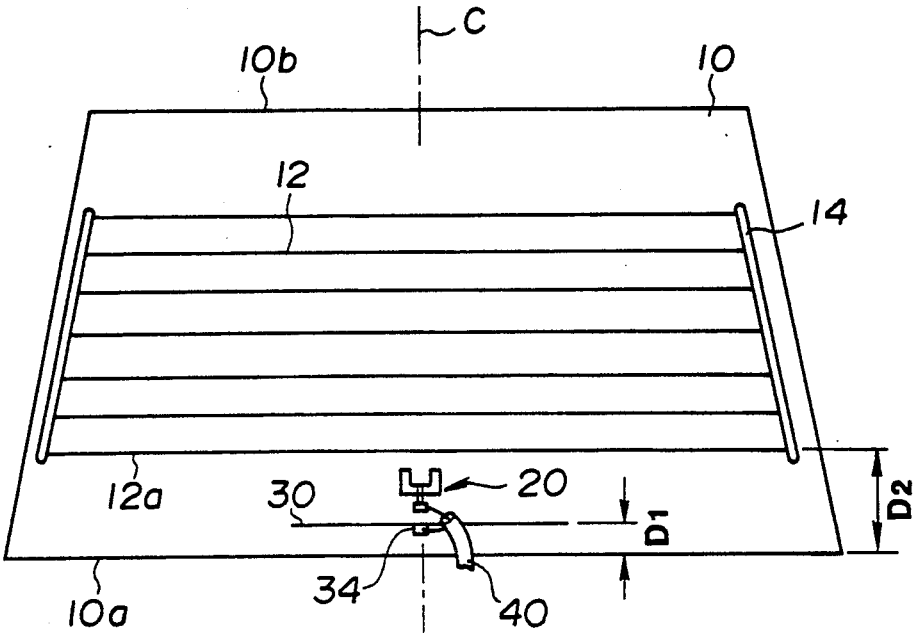
FIG. 13 is a plan view of an automobile rear window glass provided with another antenna according to the invention.
Figure 14:
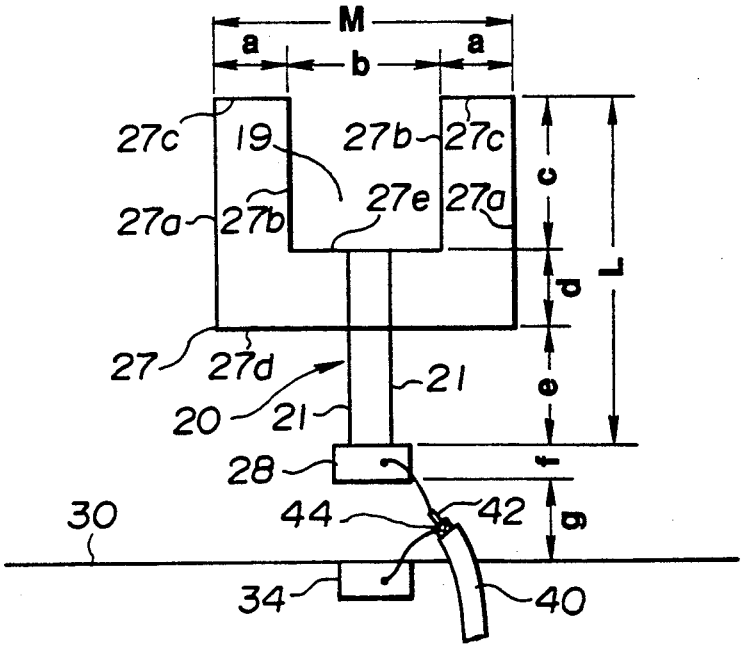
FIG. 14 is an enlarged view of the antenna in FIG. 13.

FIGS. 13 and 14 show another preferred construction of the primary antenna 20 is an antenna according to the invention. On the inboard surface of the automobile rear window glass 10 the position of the primary antenna 20 is as described with respect to the embodiment shown in FIGS. 1 and 2. The primary antenna 20 has two parallel vertical elements 21 having the same length and another linear element 27 which is bent so as to form a closed loop in the shape of a rectangle having a rectangular cut 19 in one side thereof. The element 27 is arranged such that two external sides **27*a* and two internal sides 27*b* of the deformed rectangle extend vertically and such that the rectangular cut 19 is in an upper horizontal side 27*c*. The vertical elements 21 extend from an interior horizontal side 27*e* of the element 27, intersecting the external horizontal side 27*d* of the element 27, to a feed point 28 for connection with the inner conductor 42 of the coaxial cable 40. In this embodiment the horizontal secondary antenna 30 and the feed point for connection with the outer conductor 44 of the coaxial cable 40 are similar to the counterparts in FIG. 6**.

In a sample of the window glass shown in FIGS. 13 and 14 the dimensions of the glass plate 10 were the same as in the sample of the window glass of FIG. 1. The distance $D_2$ of the array of heater strips 12 from the lower edge **10*a* of the glass 10** was 120 mm.

As to the primary antenna 20: the width M was 39 mm, and vertical length L was 45 mm. More in detail: a was 10 mm, b was 19 mm, c was 20 mm, d was 10 mm, and e was 15 mm. As to the feed point 28: width f was 5 mm, and distance g from the secondary antenna 30 was 10 mm. The secondary antenna 30 had a length of 130 mm, and the distance $D_1$ was 30 mm.

With this sample antenna transmission and reception gains (vs. half-wave dipole antenna) for vertically polarized waves in the 860–940 MHz band for car telephones were as shown in Table 6.

TABLE 6

| Frequency (MHz) | Gain (dB) |
|---|---|
| 860 | −4.5 |
| 865 | −3.3 |
| 870 | −2.4 |
| 875 | −1.2 |
| 880 | +1.3 |
| 885 | −0.9 |
| 915 | −0.8 |
| 920 | −1.4 |
| 925 | −3.2 |
| 930 | −4.8 |
| 935 | −6.0 |
| 940 | −5.8 |
| average | −2.8 |

When this sample antenna was used for the transmission and reception of vertically polarized waves for personal radios with 904 MHz as the central frequency, an average gain (vs. half-wave dipole antenna) was −0.8 dB.

These test results indicate that the antenna of FIG. 14 is comparable to conventional pole antennas. When the same sample antenna was used for the reception of TV broadcast waves in the UHF band of 470–770 MHz, an average gain (vs. standard dipole antenna) was −15.5 dB with respect to horizontal polarization and −13.7 dB with respect to vertical polarization. That is, with this window glass antenna it is possible to receive UHF TV broadcasting.

Figure 15:
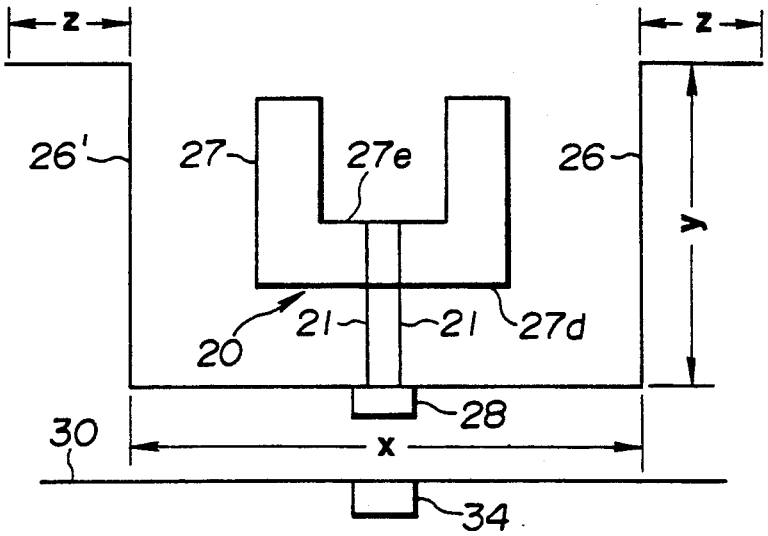
FIGS. 15 to 17 show four different modifications of the antenna of FIG. 14, respectively.

FIG. 15 shows the addition of a pair of auxiliary antenna elements 26 and 26' to the antenna of FIG. 14. The auxiliary antenna elements 26, 26' are arranged symmetrically with respect to the primary antenna 20 and respectively connected to the first feed point 28. Each of these elements 26, 26' is a linear element which is bent so as to have two horizontal portions and a vertical portion. In a sample of the antenna of FIG. 15, regarding the auxiliary elements 26, 26': x was 100 mm, y was 50 mm, and z was 10 mm.

Figure 16:
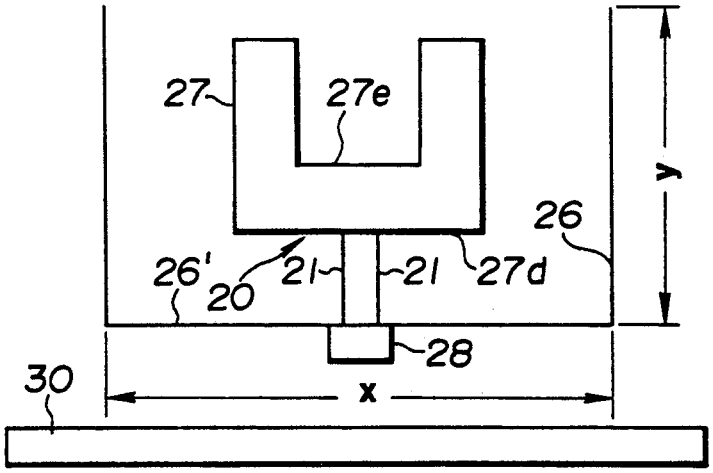

FIG. 16 shows a modification of the antenna of FIG. 15. First, the arrangement of the two parallel vertical elements 21 of the primary antenna 20 is changed so as to extend from the external horizontal side **27*d* of the element 27. Second, each of the auxiliary antenna elements 26, 26' is partly omitted so as to become an L-shaped element. In this embodiment the horizontal secondary antenna 30 has some width, so that the second feed point 34** is omitted. In a sample of this antenna: x was 100 mm, and y was 50 mm.

In the aforementioned samples of the antennas of FIGS. 15 and 16, the dimensions of the glass plate and the antenna elements were the same as in the sample of the antenna shown in FIGS. 13 and 14 except the particularly mentioned dimensions of the modified or added elements. With respect to the samples of the antennas of FIGS. 15 and 16, Table 7 shows average gains (vs. half-wave dipole antenna) in transmitting and receiving waves in the 860–940 MHz band for car telephones and average gains (vs. half-wave dipole antenna) in transmitting and receiving vertically polarized waves for personal radios with 904 MHz as the central frequency. These test results indicate that the antennas of FIGS. 15 and 16 are nearly equivalent to or slightly better than the antenna of FIG. 14.

TABLE 7

| | Average Gain (dB) | |
|---|---|---|
| | 860–940 MHz | around 904 MHz |
| antenna of FIG. 15 | −1.9 | −0.2 |
| antenna of FIG. 16 | −2.0 | −0.5 |
| antenna of FIG. 14 | −2.8 | −0.8 |

Figure 17:
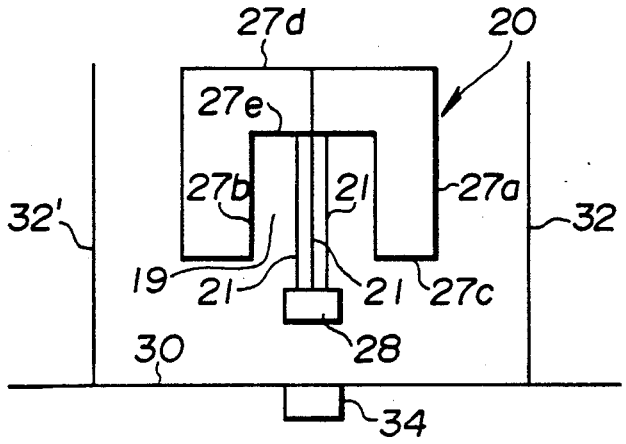

FIG. 17 shows another modification of the antenna of FIG. 14. First; the element 27 of the primary antenna 20 is rotated by 180 degrees so that the rectangular cut 19 is in the lower horizontal side **27*c* of the element 27. The two vertical elements 21 extend from the interior horizontal side 27*e* of the element 27. Second, the primary antenna 20 is supplemented with another vertical element 29 which extends between the two vertical elements 21 from the external horizontal side 27*d* of the element 27 to the feed point 28. Further, the antenna includes a pair of auxiliary antenna elements 32 and 32' each of which is a vertically arranged straight element and is connected to the horizontal secondary antenna 30. The antenna of FIG. 17 has also proved to be nearly equivalent to the antenna of FIG. 14**.

In an antenna of the type shown in FIGS. 13–17 it is suitable that the width M of the primary antenna 20 falls in the range from 20 to 75 mm, and preferably in the range from 35 to 55 mm. More particularly, it is suitable that a is 5–20 mm and preferably 10–15 mm, and that b is 10–35 mm and preferably 15–30 mm. The distance between the two vertical elements 21 is shorter than b and may range from 3 to 20 mm, and preferably from 5 to 15 mm. If desired, two or three supplementary vertical elements may be added in place of one supplementary vertical element 29 in FIG. 18. The maximum (L) of the vertical length of the primary antenna 20 ranges from 20 to 120 mm, and preferably from 30 to 70 mm, while the length e in FIG. 15 ranges from 10 to 30 mm. As to the element 27, it is suitable that the length c is 15–75 mm, and preferably 25–55 mm, and that length d is 5–20 mm, and preferably 10–15 mm. The length and position of the secondary antenna 30 are as described with reference to FIGS. 1–7. The auxiliary antenna elements 26, 26' in FIGS. 15 and 16 are added for the purpose explained hereinbefore with reference to FIGS. 5 and 6.

In the above described embodiments an antenna according to the invention is provided in a central area of the horizontally elongate space between the heater strips 12 and the lower edge **10*a*** of the window glass, but this is not limitative. The position of the antenna can be shifted to the right or to the left. For instance, when it is required to install a supplementary brake lamp, viz. so-called high-mount stop light, in the central area of the space below the heater strips the position of the antenna has to be shifted from the central area. Irrespectively of the high-mount stop lamp, there is a possibility of providing one set of antenna on the righthand side of the window glass and another set of antenna on the lefthand side with the intention of making diversity reception.

Figure 18:
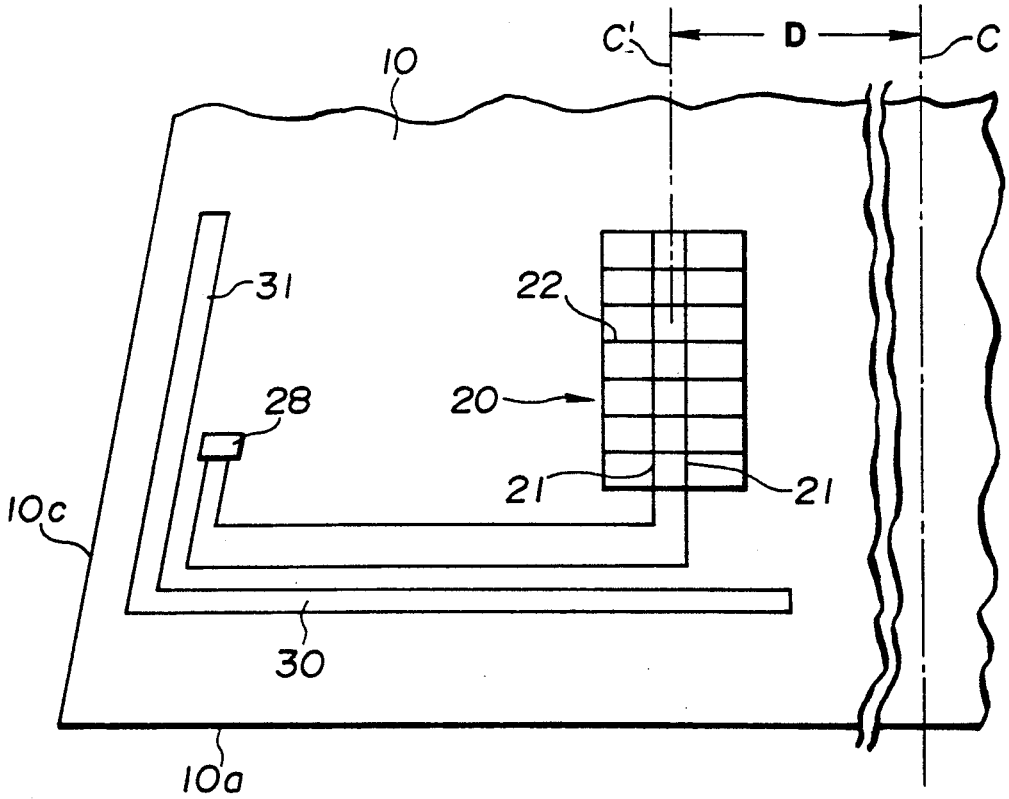
FIG. 18 shows a shift of the position of the antenna in FIG. 1 toward a side edge of the window glass with a minor change in the construction of the antenna.

For example, FIG. 18 shows a shift of the position of the antenna in FIG. 1. Within the horizontally elongate space along the lower edge **10*a* of the window glass the primary antenna 20 is shifted toward a side edge 10*c* of the window glass 10 to such an extent that the distance D of the longitudinal center axis C' of the primary antenna 20 from the center axis C of the window glass 10 becomes about 500 mm. As shown in FIG. 18, the feed point 28 for connection of the primary antenna 20 to the inner conductor of the coaxial cable may be positioned at a relatively short distance from the side edge 10*c* of the window glass. The horizontal secondary antenna 30 is also shifted toward the side edge 10*c*. It is permissible that the middle of the horizontal antenna 30 deviated from the center axis C' of the primary antenna 20 toward the side edge 10*c*. When the aforementioned distance D is longer than about 300 mm it is optional to supplement the secondary antenna 30 with a linear element 31 which extends upward from one end of the horizontal antenna 30 substantially parallel to the side edge 10*c* of the window glass. For example, the horizontal antenna 30 having a length of 130 mm was supplemented with the element 31 having a length of 80 mm. When the distance D is shorter than about 300 mm the supplementary element 31 is unnecessary. If the element 31 is added the point of connection of the secondary antenna to the outer conductor of the coaxial cable may be either in the horizontal element 30 or the nearly vertical element 31**.

In the above described embodiments an antenna according to the invention is provided in a space left between the defogging heater strips and the lower edge of the window glass taking into consideration that often another window glass antenna for the reception of radio and/or TV broadcast waves is provided in a space above the heater strips. When the space above the heater strips is left open it is possible to arrange an antenna according to the invention in that space. In that case it is favorable for the feeding to invert (rotate by 180°) the antenna arrangement in each of the above described embodiments. Needless to mention an antenna according to the invention can be provided to a vehicle windshield or a vehicle side window glass instead of providing same to a rear window glass.

Also it is optional, and rather preferable, to construct a diversity antenna system by combining an antenna according to the invention with another window glass antenna or a conventional pole antenna.

What is claimed is:

1. An antenna attached to a vehicle window glass for transmitting and receiving ultrashort waves, the window glass provided with an array of defogging heater strips, the antenna entirely disposed in a space between the array of heater strips and a lower edge of the window glass, the antenna comprising:

a primary antenna which is a combination of at least two parallel vertical elements each of which is a conductive linear element extending perpendicular to a horizontal line and at least two horizontal elements each of which is a conductive linear element extending horizontally and directly connecting with at least one of said vertical elements such that said vertical elements and said horizontal elements form a rectangular grid as the major part of the primary antenna, in said grid the spacings between said vertical elements and the spacings between said horizontal elements being not greater than 20 mm, the primary antenna being arranged within a rectangular area ranging from 10 to 120 mm in horizontal width and from 20 to 60 mm in length perpendicular to the horizontal width;

a secondary antenna which is a conductive and horizontally elongate element which extends in a space between said rectangular area and the lower edge of the window glass and has a length in the range from 30 to 300 mm; and a feeder which is a coaxial cable having an inner conductor and an outer conductor with insulation therebetween, said primary antenna being connected with said inner conductor and said secondary antenna being connected with said outer conductor.

2. An antenna according to claim 1, wherein said rectangular area ranges from 15 to 80 mm in horizontal width and from 30 to 50 mm in length perpendicular to the width.

3. An antenna according to claim 1, wherein said spacings between said vertical elements and said spacings between said horizontal elements are not smaller than 4 mm.

4. An antenna according to claim 1, wherein the length of said horizontally elongate element of said secondary antenna is in the range from 60 to 150 mm.

5. An antenna according to claim 1, further comprising at least one auxiliary antenna element which is a conductive linear element and connects with said secondary antenna.

6. An antenna according to claim 1, further comprising at least one auxiliary antenna element which is a conductive linear element and is connected to said inner conductor of said coaxial cable.

7. An antenna according to claim 1, wherein said primary antenna has a longitudinal center axis parallel to said vertical elements and is symmetrical with respect to said center axis.

8. An antenna according to claim 7, wherein said center axis approximately bisects said horizontally elongate element of said secondary antenna.

9. An antenna according to claim 1, wherein said rectangular area is located such that a vertical center axis of the window glass passes through said rectangular area.

10. An antenna according to claim 1, wherein said rectangular area is spaced from a vertical center axis of the window glass, the antenna further comprising an auxiliary antenna element which is a conductive linear element and extends from one end of said second antenna substantially parallel to a side edge of the window glass.

11. An antenna attached to a vehicle window glass for transmitting and receiving ultrashort waves, the window glass provided with an array of defogging heater strips, the antenna entirely disposed in a space between the array of heater strips and a lower edge of the window glass, the antenna comprising:

a primary antenna which is a combination of at least two parallel vertical elements each of which is a conductive linear element extending perpendicular to a horizontal line, at least two horizontal elements each of which is a conductive linear element extending horizontally from a same end of respective ones of said vertical elements and an impedance matching element which is a conductive linear element bent so as to have at least one horizontal part crossing said vertical elements and at least one vertical part extending parallel to said vertical elements, the primary antenna being arranged within a rectangular area ranging from 10 to 120 mm in horizontal width and from 30 to 100 mm in length perpendicular to the horizontal width;

a secondary antenna which is a conductive and horizontally elongate element which extends in a space between said rectangular area and the lower edge of the window glass and has a length in the range from 30 to 300 mm; and a feeder which is a coaxial cable having an inner conductor and an outer conductor with insulation therebetween, said primary antenna being connected with said inner conductor and said secondary antenna being connected with said outer conductor.

12. An antenna according to claim 11, wherein at least one of said vertical elements of said primary antenna extends from an end of one of said horizontal elements toward said horizontally elongate element of said secondary antenna.

13. An antenna according to claim 11, wherein one of said vertical elements of said primary antenna connects with one of said horizontal elements of said primary antenna so as to form a T-shaped element.

14. An antenna according to claim 11, wherein said impedance matching element forms the perimeter of a rectangle.

15. An antenna according to claim 11, wherein said impedance matching element is bent into the form of three sides of a rectangle.

16. An antenna according to claim 11, wherein said impedance matching element is bent into the form of three sides of a rectangle and two opposite end portions of the remaining side of said rectangle.

17. An antenna according to claim 11, wherein the length of said horizontally elongate element of said secondary antenna is in the range from 60 to 150 mm.

18. An antenna according to claim 11, further comprising at least one auxiliary antenna element which is a conductive linear element and connects with said secondary antenna.

19. An antenna according to claim 11, wherein said primary antenna has a longitudinal center axis parallel to said vertical elements and is symmetrical with respect to said center axis.

20. An antenna according to claim 19, wherein said center axis approximately bisects said horizontally elongate element of said secondary antenna.

21. An antenna according to claim 11, wherein said rectangular area is located such that a vertical center axis of the window glass passes through said rectangular area.

22. An antenna attached to a vehicle window glass for transmitting and receiving ultrashort waves, the window glass provided with an array of defogging heater strips, the antenna entirely disposed in a space between the array of heater strips and a lower edge of the window glass, the antenna comprising:

a primary antenna which is a combination of at least two parallel vertical elements each of which is a conductive linear element extending perpendicular to a horizontal line and another conductive linear element which is bent at right angles so as to constitute the perimeter of a closed plane figure in the shape of a rectangle having a rectangular cut in one side thereof, said rectangle being arranged such that said one side becomes a horizontal side, each of said vertical elements directly connecting with at least one horizontal side of said rectangle, the primary antenna being arranged within a rectangular area ranging from 20 to 75 mm in horizontal width and from 20 to 120 mm in length perpendicular to the horizontal width;

a secondary antenna which is a conductive and horizontally elongate element which extends in a space between said rectangular area and the lower edge of the window glass and has a length in the range from 30 to 300 mm; and a feeder which is a coaxial cable having an inner conductor and an outer conductor with insulation therebetween, said primary antenna being connected with said inner conductor and said secondary antenna being connected with said outer conductor.

23. An antenna according to claim 22, wherein said rectangular area ranges from 35 to 55 mm in horizontal width and from 30 to 70 mm in length perpendicular to the width.

24. An antenna according to claim 22, wherein said vertical elements cross a horizontal side of said rectangle and extend to another horizontal side which defines the bottom of said rectangular cut.

25. An antenna according to claim 22, wherein said vertical elements extend from a horizontal side of said rectangle without entering said rectangle.

26. An antenna according to claim 22, wherein said vertical elements extend through said rectangular cut.

27. An antenna according to claim 22, further comprising at least one auxiliary antenna element which is a conductive linear element and partially extends parallel to said vertical elements, said at least one auxiliary antenna element being connected with said inner conductor of said coaxial cable.

28. An antenna according to claim 22, further comprising at least one auxiliary antenna element which is a conductive linear element and partially extends parallel to said vertical elements, said at least one auxiliary antenna element connecting with said secondary antenna.

29. An antenna according to claim 22, wherein said primary antenna has a longitudinal center axis parallel to said vertical elements and is symmetrical with respect to said center axis.

30. An antenna according to claim 29, wherein said center axis approximately bisects said horizontally elongate element of said secondary antenna.

31. An antenna according to claim 22, wherein said rectangular area is located such that a vertical center axis of the window glass passes through said rectangular area.

* * * * *